US005690150A

United States Patent [19]

Huey et al.

[11] Patent Number: 5,690,150

[45] Date of Patent: Nov. 25, 1997

[54] WOVEN FABRIC MADE WITH A YARN HAVING PERIODIC FLAT SPOTS

[75] Inventors: Larry J. Huey, North Augusta; Thomas A. Coakley, Aiken, both of S.C.

[73] Assignee: Owens-Corning Fiberglas Technology, Inc., Summit, Ill.

[21] Appl. No.: 683,073

[22] Filed: Jul. 16, 1996

[51] Int. Cl.[6] ..... D03D 15/00

[52] U.S. Cl. ..... 139/426 R; 139/383 R; 139/420 C; 442/193; 442/210

[58] Field of Search ..... 139/420 A, 426 R, 139/383 R, 420 C, 426 TW, 389, 384 R, 416, 417, 425 R, 420 B; 428/229; 442/193, 210

[56] References Cited

U.S. PATENT DOCUMENTS

| | | | |
|---|---|---|---|
| 1,591,020 | 7/1926 | Damon . | |
| 2,189,370 | 2/1940 | Shiranezawa | 139/426 R |
| 2,309,825 | 2/1943 | Burdett | 139/383 R |
| 2,922,491 | 1/1960 | Macks . | |
| 2,935,363 | 5/1960 | Schindel . | |
| 2,986,433 | 5/1961 | Herrmann . | |
| 3,109,602 | 11/1963 | Smith . | |
| 3,292,871 | 12/1966 | Smith et al. . | |
| 3,334,980 | 8/1967 | Smith . | |
| 3,367,587 | 2/1968 | Klink et al. . | |
| 3,371,877 | 3/1968 | Klink et al. . | |
| 3,408,012 | 10/1968 | Smith et al. . | |
| 3,498,550 | 3/1970 | Klink et al. . | |
| 3,523,650 | 8/1970 | Klink et al. . | |
| 3,612,256 | 10/1971 | Limbach | 139/425 R |
| 3,612,631 | 10/1971 | O'Connor . | |
| 3,664,596 | 5/1972 | Lenk . | |
| 3,717,331 | 2/1973 | Simons . | |
| 3,819,122 | 6/1974 | Genson . | |
| 3,838,827 | 10/1974 | Klink et al. . | |
| 3,900,166 | 8/1975 | Sartori . | |
| 3,998,404 | 12/1976 | Reese . | |
| 4,045,195 | 8/1977 | Drummond . | |
| 4,130,248 | 12/1978 | Hendrix et al. . | |
| 4,167,252 | 9/1979 | Klink et al. . | |
| 4,170,459 | 10/1979 | Myers . | |
| 4,206,884 | 6/1980 | Myers . | |
| 4,364,762 | 12/1982 | Sullivan et al. . | |
| 4,383,653 | 5/1983 | Nakazawa et al. . | |
| 4,415,126 | 11/1983 | Nakazawa et al. . | |
| 4,465,241 | 8/1984 | Merritt . | |
| 4,638,955 | 1/1987 | Schippers et al. . | |
| 4,958,664 | 9/1990 | Oppl et al. . | |
| 5,033,685 | 7/1991 | Busenhart et al. . | |

FOREIGN PATENT DOCUMENTS

| | | | |
|---|---|---|---|
| 662572 | 6/1938 | Germany | 139/426 R |

OTHER PUBLICATIONS

"Micro–Fog Lubricator," C.A. Norgren Co., 1988.

*Primary Examiner*—Andy Falik

*Attorney, Agent, or Firm*—C. Michael Gegenheimer; Inger H. Eckert

[57] ABSTRACT

A woven fabric of warp yarn and fill yarn uses a strand of individual filaments for the fill yarn, where the strand has a primary cross-sectional shape and periodic flat spots with a flat cross-sectional shape which is more elongated than the primary cross-sectional shape, where the effect of the flat spots is differentiated fill yarn in the woven fabric.

20 Claims, 7 Drawing Sheets

WOVEN FABRIC MADE WITH A YARN HAVING PERIODIC FLAT SPOTS

CROSS-REFERENCE TO RELATED APPLICATIONS

The present invention is related to the inventions of the following U.S. patent applications: Ser. No. 08/683,014, entitled METHOD AND APPARATUS FOR LUBRICATING CONTINUOUS FIBER STRAND WINDING APPARATUS, filed Jul. 16, 1996; Ser. No. 08/680,083, entitled APPARATUS FOR PRODUCING SQUARE EDGED FORMING PACKAGES FROM A CONTINUOUS FIBER FORMING PROCESS, filed Jul. 16, 1996; Ser. No. 08/683,005, entitled ZERO TWIST YARN HAVING PERIODIC FLAT SPOTS, filed Jul. 16, 1996; Ser. No. 08/683,015, entitled METHOD OF CONTROLLING FLAT SPOTS IN A ZERO TWIST YARN, filed Jul. 16, 1996; Ser. No. 08/683,017, entitled METHOD OF WEAVING A YARN HAVING PERIODIC FLAT SPOTS ON AN AIR JET LOOM, filed Jul. 16, 1996; and Ser. No. 08/683,016, entitled SELF-SUPPORTING YARN PACKAGE.

TECHNICAL FIELD

This invention relates to the production of glass fiber strands, and in the packaging, dispensing and weaving of yarn for use as a reinforcement or decorative material.

BACKGROUND OF THE INVENTION

Mineral fibers are used in a variety of products. The fibers can be used as reinforcements in products such as plastic matrices, reinforced paper and tape, and woven products. During the fiber forming and collecting process numerous fibers are bundled together as a strand. Several strands can be gathered together to form a roving used to reinforce a plastic matrix to provide structural support to products such as molded plastic products. The strands can also be woven to form a fabric, or can be collected in a random pattern as a fabric. The individual strands are formed from a collection of glass fibers, or can be comprised of fibers of other materials such as other mineral materials or organic polymer materials. A protective coating, or size, is applied to the fibers which allows them to move past each other without breaking when the fibers are collected to form a single strand. The protection of the size allows the strand to be manipulated in various fabrication processes, such as weaving. Where the fibers are to be used in an industrial application, the size improves the bond between the strands and the plastic matrix. The size may also include bonding agents which allow the fibers to stick together forming an integral strand.

Typically, continuous fibers, such as glass fibers, are mechanically pulled from a feeder of molten glass. The feeder has a bottom plate, or bushing, which has anywhere from 200 to 10,000 orifices. In the forming process, the strand is wound around a rotating drum, or collet, to form, or build, a package. The completed package consists of a single long strand. It is preferable that the package be wound in .a manner which enables the strand to be easily unwound, or paid out. It has been found that a winding pattern consisting of a series of helical courses laid on the collet builds a package which can easily be paid out. Such a helical pattern prevents adjacent loops or wraps of strand from binding together should the strand be still wet from the application of the size material. The helical courses are wound around the collet as the package begins to build. Successive courses are laid on the outer surface of the package, continually increasing the package diameter, until the winding is completed and the package is removed from the collet.

A strand reciprocator guides the strand longitudinally back and forth across the outer surface of the package to lay each successive course. A known strand reciprocator is the spiral wire type strand oscillator. It consists of a rotating shaft containing two outboard wires approximating a spiral configuration. The spiral wires strike the advancing strand and direct it back and forth along the outer surface of the package. The shaft is also moved longitudinally so that the rotating spiral wires are traversed across the package surface to lay the strand on the package surface. While building the package, the spiral wire strand oscillator does not contact the package surface. Although the spiral wire strand oscillator produces a package that can be easily paid out, the package does not have square edges. A package having square edges can have a larger diameter than packages with rounded edges. Also, a square edged package can be stacked during shipping. It is desirable to build cylindrical packages having square edges and larger diameters.

A known strand reciprocator which produces square edged, cylindrical packages includes a cam having a helical groove, a cam follower which is disposed within the groove and a strand guide attached to the cam follower. As the cam is rotated, the cam follower and strand guide move the strand longitudinally back and forth across the outer surface of the rotating package to lay each successive course. A rotatable cylindrical member, or roller bail, contacts the outer surface of the package as it is being built to hold the strand laid in the latest course in place at the package edges as the strand guide changes direction. The contact between the roller bail and the rotating package surface causes the roller bail to rotate, and the speed of the roller bail surface is generally equal to the speed of the package surface. An alternative version uses the strand guide itself to contact the package and hold down the strand momentarily at the edge of the package.

To increase productivity, several packages are built simultaneously on a single collet. A separate strand is formed for each package, and a separate strand reciprocator oscillates each strand to build the packages simultaneously. The strand reciprocators are mounted on an arm which moves the strand reciprocators away from the collet as the package radius increases while keeping the roller bails in contact with the package surfaces. The fiber forming process, including the bushing temperature, is controlled to keep the fiber diameters constant throughout the collection process, and to keep the package radii of each of the packages increasing at a similar rate.

Process variations do occur, however, resulting in slight variations in package size along the collet during the collection process. These differences in the relative radii of the packages on the collet cause roller bails to occasionally leave the surface of a package. When a roller bail loses contact with the package surface, the rotational speed of the roller bail begins to decrease. As the surface of the roller bail comes back into contact with the package surface the rotational speed of the roller bail increases until the surface of the roller bail is traveling at the same speed as the surface of the package. Due to bearing friction and the inertia of the roller bail, the roller bail takes time to spin back up to speed. While the roller bail is spinning back up to speed, the difference in speed between the package surface and the roller bail surface causes the roller bail to skid against the package surface. The skidding roller bail produces abrasive forces which can break fibers in the strand if the inertia is too high. In addition, skidding can occur during startup as the rotational speed of the collet is increased. Strand fibers that break tend to separate from the strand as it is wound on the package and wrap around the rotating roller bail, creating a snarl which can ruin the package.

After fibrous materials are produced, they are frequently processed on looms or other weaving devices to produce woven fabrics. German patent No. 662,572, for example, discloses a woven fabric having twisted warp threads, and fill threads that have an appearance of varied diameter along their length.

U.S. Pat. No. 2,189,370 to Shiranezawa discloses a fabric having warp threads and weft threads, with a hollow knitted cord interwoven between alternate weft threads, parallel to the weft threads. The patent to Shiranezawa discloses that the cords have swelled out portions, shown in the drawing as being periodically positioned in the fabric, i.e., in a pattern. The Shiranezawa reference teaches that these swelled out portions are created during a finishing process which substantially shrinks the weft threads, thereby bunching up the chords.

U.S. Pat. No. 2,309,825 to Burdett discloses that a woven fabric can have a decorative warp yarn, with ground warp threads forced into alignment with the decorative warp threads.

U.S. Pat. No. 3,612,256 to Limbach et al. discloses a woven belting fabric having warps of metallic cables, with the warps being compacted and maintained coplanar, parallel and linear by selectively inwardly crimped wefts positioned in layers above and below the warps.

While the above-mentioned patents disclose improvements in woven products, it would be advantageous to provide a woven fabric with the fill or warp yarn made of strands having a primary cross-sectional shape, and having periodic flat spots with a flat cross-sectional shape which is more elongated than the primary cross-sectional shape, where the effect of the flat spots is differentiated fill or warp yarn in the woven fabric.

SUMMARY OF THE INVENTION

There has now been developed a woven fabric which provides a unique appearance by having differentiated yarn in various positions throughout the fabric. The fabric is comprised of warp yarn and fill yarn, where the fill yarn is a strand of individual filaments, the strand having a primary cross-sectional shape and periodic flat spots with a flat cross-sectional shape which is more elongated than the primary cross-sectional shape. The effect of the flat spots is differentiated fill yarn in the woven fabric. In a specific embodiment of the invention, the differentiated fill yarn is lighter in color than the remainder of the fill yarn. In another embodiment of the invention, the differentiated fill yarn is more reflective than the remainder of the fill yarn.

The differentiated fill yarn is expected to be wider than the remainder of the fill yarn, and preferably has an average width which is within the range of from about 125 to about 300 percent of the average width of the remainder of the fill yarn. More preferably, the differentiated fill yarn has an average width which is within the range of from about 125 to about 175 percent of the average width of the remainder of the fill yarn.

In a preferred embodiment of the invention, the average length of the differentiated fill yarn is within the range of from about 0.5 to about 10 cm, and more preferably within the range of from about 1 to about 5 cm.

In a specific embodiment of the invention, the differentiated fill yarn is generally randomly spaced throughout the fabric.

In another embodiment of the invention, the differentiated fill yarn is generally aligned with specific warp yarn to form a longitudinal pattern along the length of the fabric.

In yet another embodiment of the invention, the differentiated fill yarn forms a repeating pattern in the fabric.

DETAILED DESCRIPTION AND PREFERRED EMBODIMENTS

Figure 1:
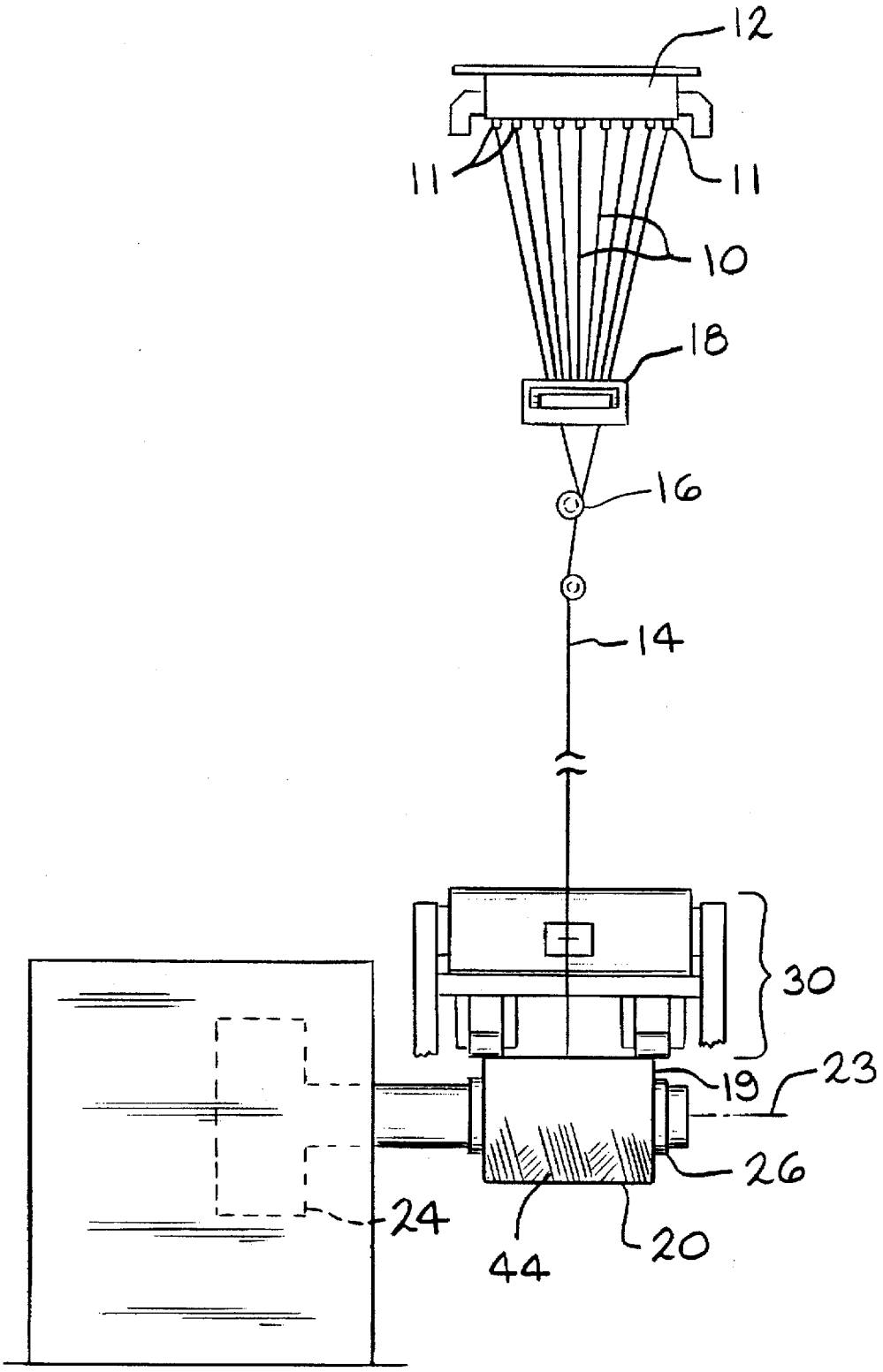
FIG. 1 is a schematic view in elevation of apparatus for forming, collecting and winding fiber strands according to the principles of the invention.
Figure 2:
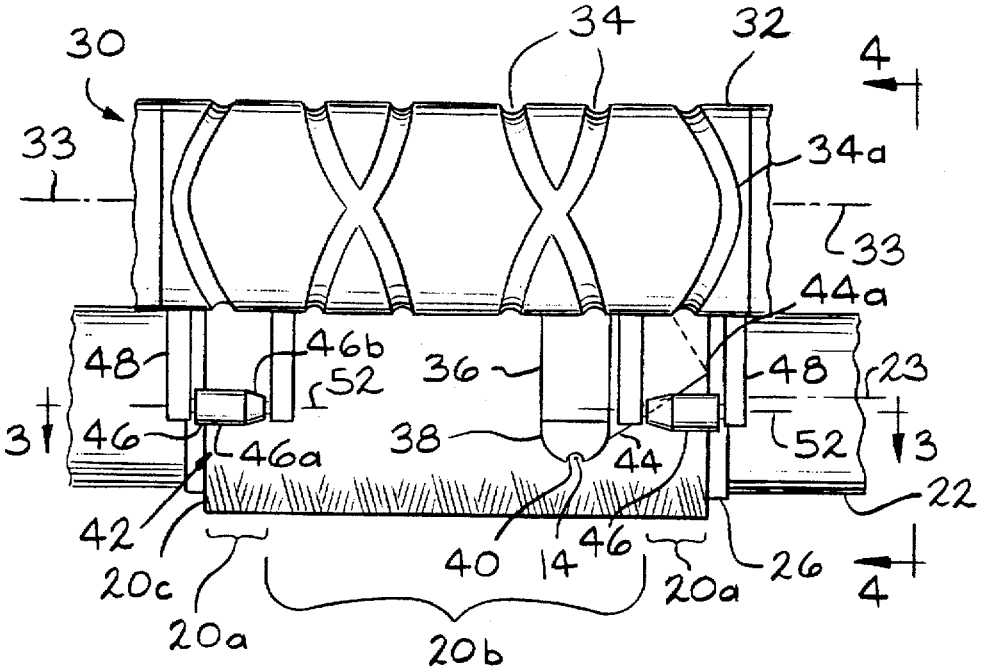
FIG. 2 is an enlarged, schematic view in elevation of the strand reciprocator shown in FIG. 1.

FIGS. 1 and 2 show apparatus for forming, collecting, and winding strands in which fibers 10 are drawn from a plurality of orifices 11 in a bushing 12 and gathered into a strand 14 by means of a gathering member 16. A size suitable for coating the fibers can be applied to the fibers by any suitable means, such as size applicator 18. The strand is wound around a rotating collet 22 to build a cylindrical package 19. The package, formed from a single, long strand, has a radially outer surface 20 with square edge portions **20*a* and a central portion 20*b* between them. The square edge portions 20*a* form generally right angles with the package ends 20*c*. The outer surface of the cylindrical package is preferably between about 10 cm to about 40 cm long, but may be longer or shorter depending on the application. The collet is adapted to be rotated about an axis of rotation 23 by any suitable means such as a motor 24. Any suitable package core material such as a cardboard tube 26** can be disposed on the collet to receive the strand package.

FIG. 2 shows a strand reciprocator 30 which guides the strand 14 laterally back and forth across the package surface 20 to lay the strand in courses 44 on the package surface. The strand reciprocator includes a cylindrical cam 32 having a helical groove 34. The cam is mounted for rotation and preferably made of a hard material, such as stainless steel, but any suitable material can be used. The strand reciprocator further includes a cam follower 36 that is disposed in the groove 34. The cam follower extends outwardly from the cam and a strand guide 38 is attached to the end. The cam follower is preferably made of a plastic or nylon material, but any suitable material can be used. A notch 40 is formed in the strand guide to hold the strand 14. Rotation of the cam causes the cam follower to follow the helical groove, thereby causing the strand guide to move laterally across the package surface.

Figure 3:
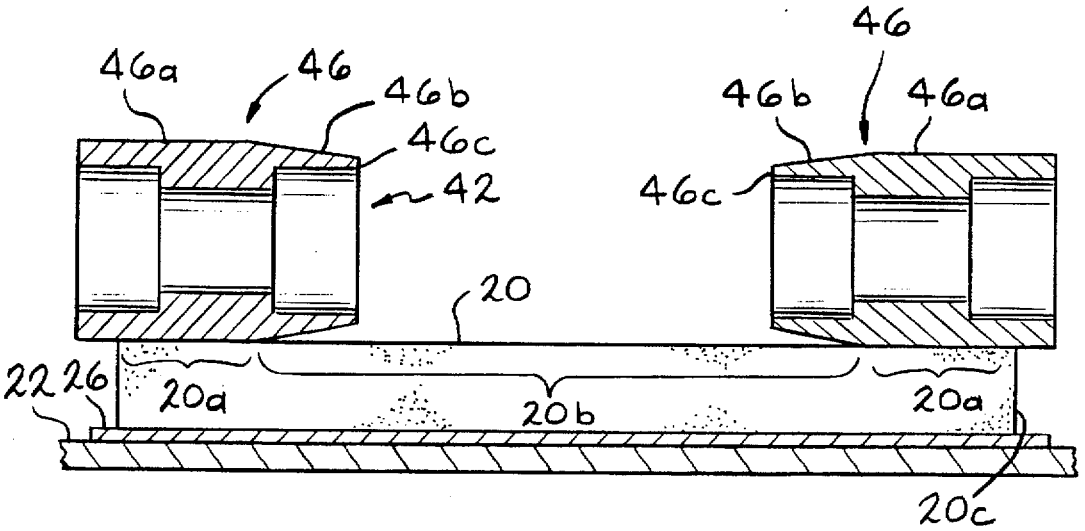
FIG. 3 is a schematic cross-sectional view in elevation of the apparatus of FIG. 2, taken along line 3—3.

Referring now to FIGS. 2 and 3, the strand reciprocator further includes a roller bail assembly 42 for holding the strand courses 44 in place at the edge portions 20*a* of the package surface 20 as the strand guide 38 changes direction. The roller bail assembly includes a pair of spaced apart, or split rollers 46. The rollers have generally cylindrical edge ends 46*a* and tapered inner ends 46*b*. The cylindrical edge ends contact the package surface at the edge portions 20*a*. The tapered inner ends extend from the edge ends towards the central portion of the package surface 20*b*. The rollers do not contact the surface of the package at the central portion of the package 20*b*. Each of the rollers 46 is independently mounted for rotation by mounts 48. One or more bearings (not shown) are located between the roller bails and the mounts to allow the roller bails to rotate freely by reducing friction. Although the roller bails are shown as mounted at both the edge ends and the inner ends, the roller bails may be cantilevered, being mounted at only one end. Each roller is made from a hard material, such as stainless steel, but any suitable material may be used. The rollers preferably weigh approximately 50 grams each, but may be heavier or lighter depending on their size and the application. They are preferably hollow to minimize weight and inertia, but may be solid. Each roller is preferably about 2 cm long, but they may be longer or shorter depending on the application.

The split roller bails are preferably coaxial, contacting the package surface along a portion of a line 52 which is generally parallel to the package axis of rotation 23, although, any suitable orientation of the roller bails may be used. Using 2 cm long roller bails, the length of contact between the roller bails and the typical package surface will be approximately 10% to 50% of the length of the outer surface of the package. A longer or shorter length of contact between the roller bails and the package surface may be used depending on the application.

Figure 4:
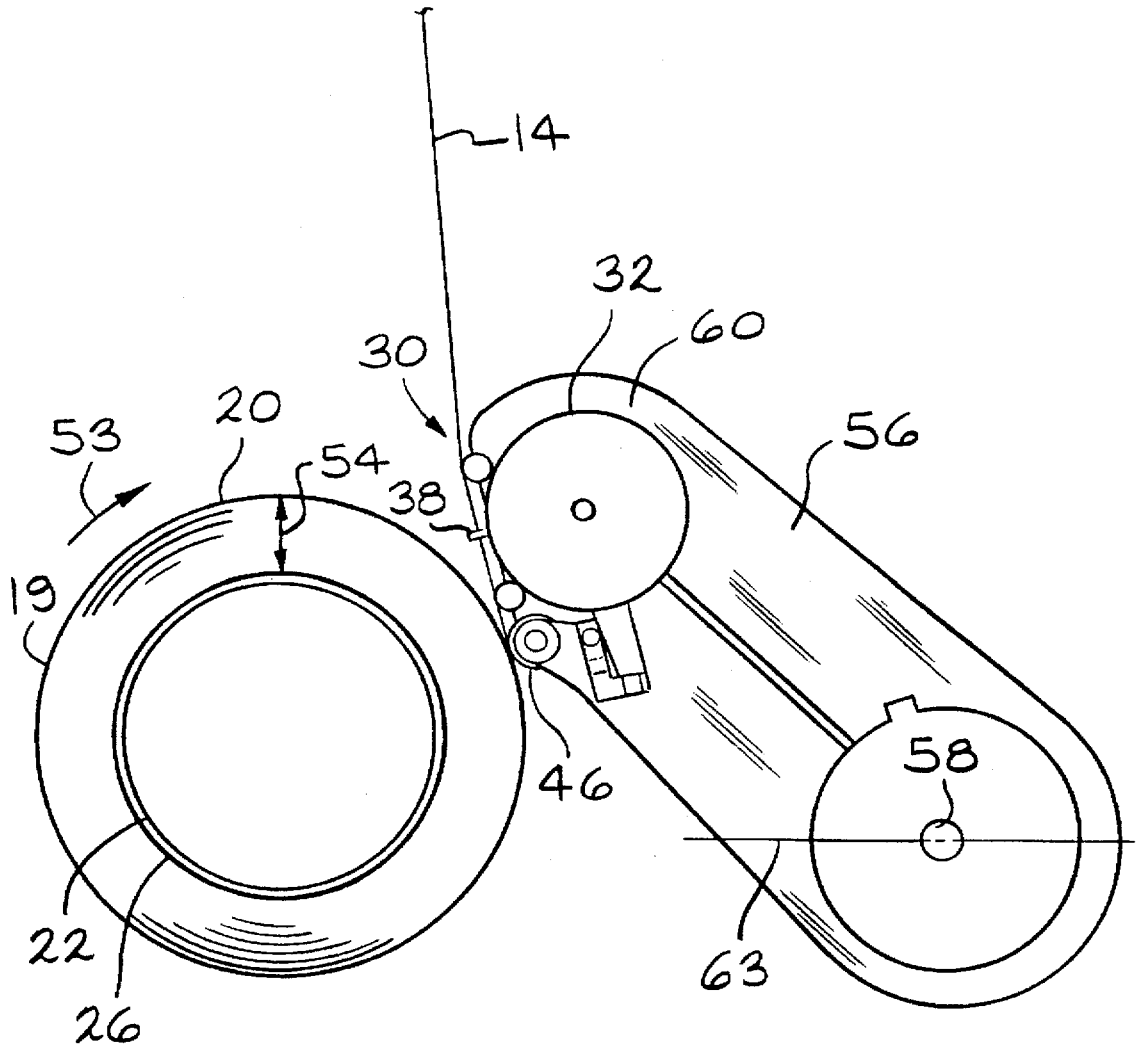
FIG. 4 is an end view in elevation of a portion the roller bail assembly of FIG. 1.

The package rotates during winding as shown by line 53 in FIG. 4. As the package builds, the radius 54 increases. To accommodate the increasing package radius, the strand reciprocator 30 is mounted on an arm 56. To accommodate the increasing package radius, the arm moves away from the collet along line 63 to keep the proper contact between the surface of the rollers and the package surface and prevent the strand courses 44*a* from pulling away from the edge portions 20*b* of the package surface.

Figure 5:
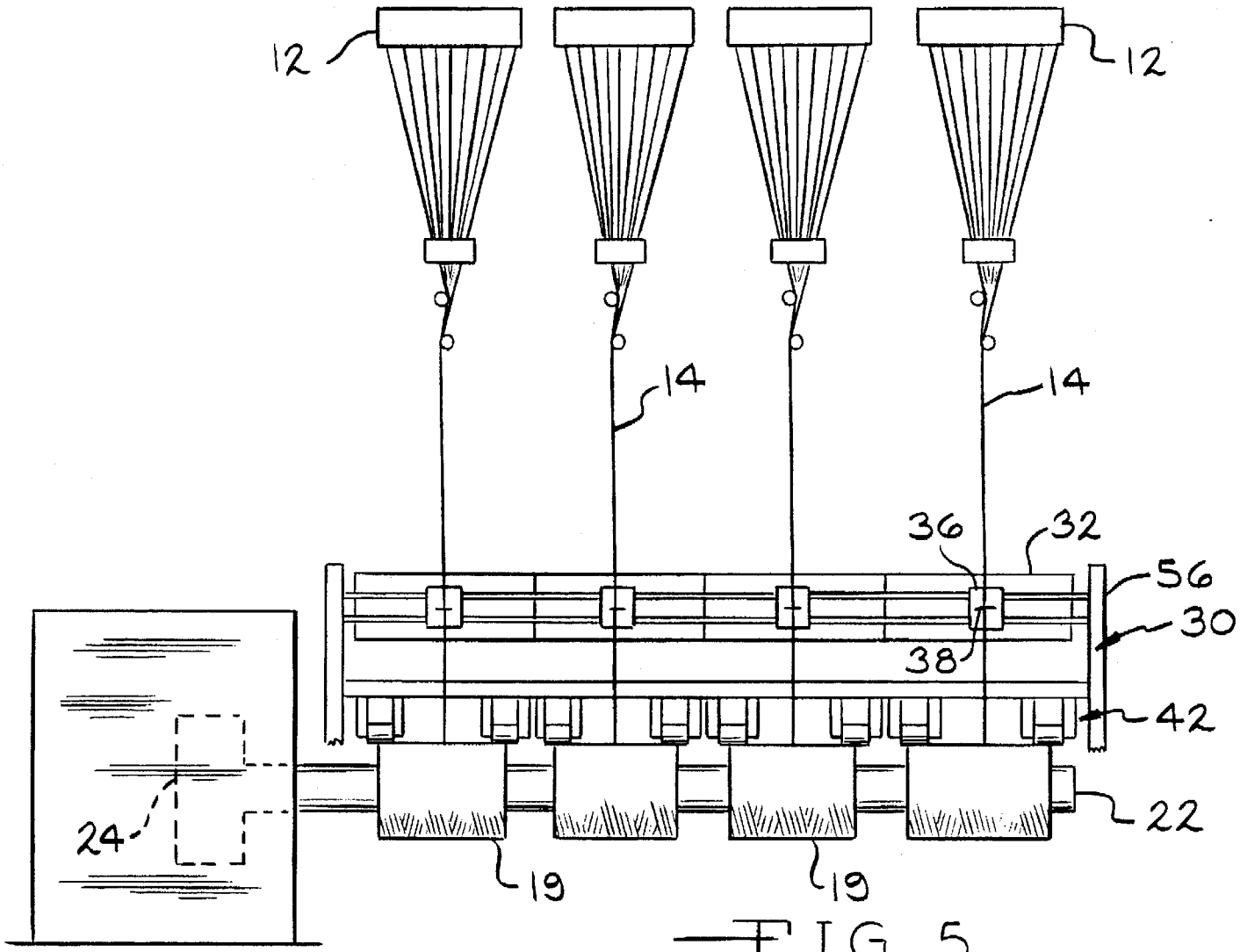
FIG. 5 is a diagrammatic view of an embodiment of the invention in which several packages are being wound simultaneously.

Several packages can be built simultaneously on the collet, as shown in FIG. 5. Each package is built by drawing separate strands 14 from separate bushing sections. The strands are wound around a single collet 22 to form packages 19. A separate strand reciprocator, including cam 32, cam follower 36, strand guide 38 and roller bail assembly 42, is used to build each package. The packages are spaced apart along the collet and the strand reciprocators are spaced along the arm 56 in a similar manner so as to be aligned with the packages.

The winding apparatus operates as follows. The strand reciprocator 30 guides the strand 14 as it is laid on the outer surface of the package. The strand is held by notch 40 in the strand guide 38 and wound around the rotating collet 22 or a package core 26 disposed about the collet. The cam 32 is oriented near the package and rotates about an axis 33 generally parallel to the package axis of rotation 23. The cam follower is disposed within the cam groove 34, but is prevented from rotating with the cam. As the cam rotates, the cam follower is moved laterally by the helical groove in a direction generally parallel to the package axis of rotation 23. The helical groove is continuous, having curved ends 34*a* that cause the cam follower to move to the end of the package and then reverse direction. The strand guide is attached to the cam follower and it traverses the outer surface of the package, reciprocating back and forth from end to end.

The helical winding pattern of each strand course 44 is formed by reciprocating the strand across the package surface while rotating the package. As the strand guide approaches the package edge portion 20*a*, the strand is laid on the package surface under the roller tapered inner edge 46*b*. The strand guide continues to move towards the end of the package 20*c* and the strand course, shown in phantom at 44*a*, moves between the package surface and the cylindrical edge end of the roller which is in contact with the package surface. When the cam follower travels through the curved end 34*a* of the groove 34, the strand guide 38 changes direction and moves away from the package edge and towards the central portion of the package 20*b*. The contact between the roller bails and the package surface holds the strand course 44*a* in place at the edge portions 20*a* of the package surface, when the strand guide changes direction. By preventing the strand courses 44*a* from pulling away from the package edge portions 20*a* as the strand guide moves back towards the center of the package 20*b*, a cylindrical package having square edges is built.

The rolling contact between the rollers and the rotating package surface causes the rollers to rotate. The speed of the roller surface is generally equal to the speed of the package surface and the speed of the strand. When the speeds are equal, there is little abrasive force between the strand and the roller bails.

In the multiple package operation, the fiber forming process is controlled to keep all the packages building, and the package radii increasing, at a similar rate. However, differences in package radii occur during winding because the diameters of the strands are not always equal from package to package. Fluctuations in bushing temperatures, and inconsistencies in material properties can change the diameter of the fibers, and thus the strands, from package to package. Therefore, one package radius may temporarily vary from the others until process corrections are made. Current injection is sometimes used to regulate the temperature of the bushings to control strand diameter. Differences in the radii of the packages can cause the roller bails to occasionally leave the surface of a package. When a roller loses contact with the package surface, the rotational speed of the roller begins to decrease. Later, as the surface of the roller comes back into contact with the package surface, the rotational speed of the roller increases until the surface of the roller is traveling at the same speed as the surface of the package. Due to the lower inertia of the split roller bails, the roller bails spin back up to speed more quickly than a single, heavier prior art roller bail which contacts the package surface from end to end. Since the split roller bails have less inertia, they skid less and produce less abrasive forces against the strands, and therefore are less likely to break any of the individual fibers in the strands. In addition, when the collet is accelerating during startup, the split roller bails produce less abrasive forces against the strand while they are accelerating and, therefore, break few fibers.

Strand fibers that do break tend to separate from the strand as it is wound on the package and wrap around the rotating roller bail, creating a snarl which can ruin the package. The split rollers provide break surfaces which break the snarling, broken fibers. The rollers include cylindrical portions 46*a* forming contact surfaces which abut the edge portions 20*a* of the package surface 20, and tapered portions 46*b* which do not contact the package surface. The tapered surfaces extend from the contact surfaces toward the central portion of the package surface 20*b*. The ends 46*c* of the tapered surfaces 46*b* form the break surfaces. As the strand guide moves the strand away from the roller 46 towards the central portion 20*b* of the package surface 20, any broken fibers that have begun to wind around the roller will be broken off from the strand 14. Because the strand is no longer in contact with a roller over the central portion of the package, the broken fibers cling to the main body of the strand due to the size mentioned above, and the entire strand is wound around the package. By the time the strand reaches the other roller at the opposite package edge, the broken fibers have been integrated with the strand and the strand has been wound around the package. The broken fibers do not wrap around the other roller. Although the tapered surface 46*b* having an edge 46*c* is shown, the break surface can also include any surface discontinuity on the roller such as a groove or shoulder. A discontinuity, or abrupt change in the roller surface will not allow the fiber to continue to wind around the roller; the fiber will be broken as the strand moves across the discontinuity. In addition, a knife edge or similar protrusion spaced apart from the roller surface may be used as a break surface. Although it is preferable for the strand not to contact the roller surface immediately after the snarling fiber has been broken off, it is not required.

Figure 6:
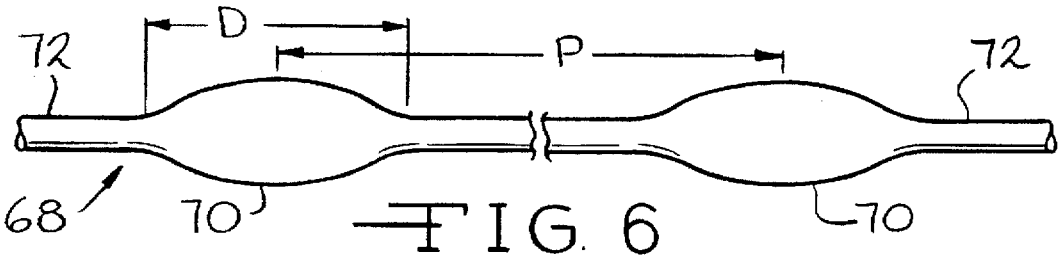
FIG. 6 is a schematic plan view of the yarn of the invention.
Figure 7:
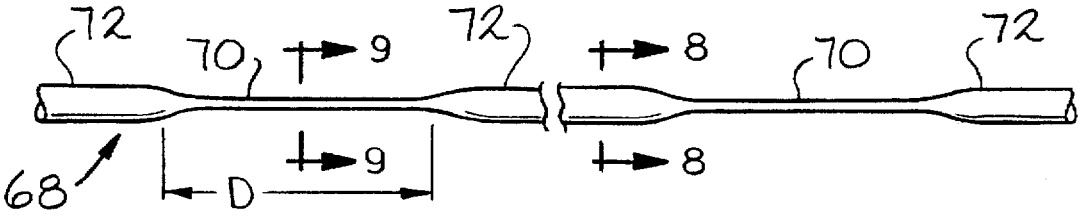
FIG. 7 is a schematic view in elevation of the yarn of the invention.

As shown in FIGS. 6 and 7, the yarn or strand 68 produced by the winding apparatus of the invention has periodically occurring flat spots 70 which are created by the pressing of the rollers 46 on the package 20. As the strand is laid onto the rotating package, the yarn is still wet with the size coating applied by the size applicator 18. After the size dries, the pressed portions of the strand are retained in the flat shape as the flat spots shown in FIGS. 6 and 7.

Figure 8:
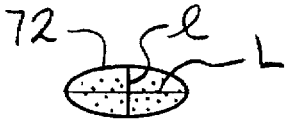
FIG. 8 is a schematic cross-sectional view of the yarn taken along line 8—8 of FIG. 7.
Figure 9:
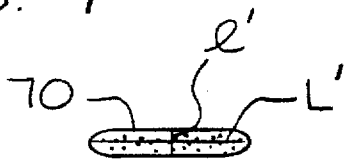
FIG. 9 is a schematic cross-sectional view of the yarn taken along line 9—9 of FIG. 7.

The strand, which usually has at least 50 and preferably at least 200 glass fiber filaments, has a primary cross-sectional shape 72 which is interrupted by the periodic flat spots 70. The primary cross-sectional shape will depend of several factors, including the amount and adhesiveness of the size, the tension of the winding process, and the number and denier of the filaments in the strand. Typical fiber diameters are within the range of from about 2.5 to about 13 microns in diameter, and the yardage is typically within the range of from about 2.7 to about 270 tex (grams/km) (180,000 to 1,800 yards per pound). Under normal operating conditions the winding of the strand will produce a primary cross-sectional shape of the strand which is somewhat flattened or elongated, as shown in FIG. 8. The primary cross-sectional shape is the shape of the strand between the flat spots, and preferably the primary cross-sectional shape has an aspect ratio within the range of from about 1:1 to about 1:6. The aspect ratio is the long dimension or length L divided by the short dimension 1. The flat spots are considerably flatter than the areas of primary cross-sectional shape, and preferably have a flat cross-sectional shape with an aspect ratio greater than about 1:6, as shown in FIG. 9. The aspect ratio of the flat spots is the long dimension or length L' divided by the short dimension 1'. More preferably, the aspect ratio of the flat cross-sectional shape is greater than about 1:20. A preferred range of the aspect ratio of the flat cross-sectional shape is from about 1:6 to about 1:50. As shown in FIG. 6, the width of the flat spots 70 is considerably wider than the width of the area of primary cross sectional shape. It is expected that the width of the flat spots will be within the range of from about 5 to about 20 times the width of the primary cross-sectional shape, although other ratios are possible.

The strand or yarn of the invention, having the periodically occurring flat spots, results in some unique properties when the strand is applied to or incorporated in different products or processes. The flat spots are usually evident in some way, such as being visually evident, thereby providing a distinctive character for the flat spot when compared to the remainder of the yarn. Therefore, the flat spots create a different or differentiated yarn where they occur, thereby forming a "differentiated" yarn. For example, the flat spots in yarn used to make a woven fabric may stand out as being more reflective in the fabric than the remainder of the fill yarn, and therefore the effect of the flat spots is to create threads which are differentiated from the rest.

The strand or yarn having the periodic flat spots can be used for many purposes. One possible use is as a fill yarn for a woven fabric of the type used as a cloth for reinforcing printed circuit boards. The yarn of the invention can be used to advantage in numerous industrial applications, where the larger surface area at the flat spots will exhibit greater bonding with resin matrices. Industrial tapes will require less adhesive to provide the same adhesion between the glass fiber reinforcement and the resin. Multi-axial non-woven scrims, which rely on bonding of the fibrous layers where they intersect, can be made stronger or with a reduced binder content. The yarn of the invention can be used as input for a chopped strand mat making machine. The yarn can also be used in a beaming operation. In short, the periodic flatness of the yarn is potentially valuable anywhere a bond between the yarn and another substance is desirable.

The length of the period P between centers of the flat spots can be controlled by controlling the length of strand wound on the central portion 20*b* of the package, between the edge portions 20*a* and 20*b*. This can be accomplished by adjusting the speed of winding process and the angle of the laydown of the strand on the package. Smaller wind or laydown angles result in many revolutions of the package between the ends, and hence a large period P between flat spots. In conventional strand packaging, the wind angle is typically held to a range between about 4 to about 9 degrees, although other angles are also possible. The wind angle required for stable packages and good runout of the strand from the package will be a function of the type and weight of the strand, and the type and amount of size on the fibers. Sharper or greater wind angles cause the strand to travel quickly from one end to the other, resulting in a short period between flat spots. The wind angle is also affected by the speed at which the strand guide 38 is reciprocated from end to end of the package. Therefore, the flattening of the strand can be controlled by controlling the speed at which the strand is traversed. In a specific embodiment of the invention the speed of the traverse of the strand is controlled as the package increases in diameter to provide a constant, fixed period P between flat spots.

As the strand is wound around the package, the package diameter increases. This will also affect the period P between flat spots since the distance traveled by the strand around the package would be increased over time. Typical speeds for the travel of the yarn are within the range of from about 100 to about 1000 meters per minute, although higher speeds are possible. One method for assuring a constant period is to adjust the wind angle as the package builds to compensate for the increased package diameter. In a preferred embodiment of the invention, the period of the periodic flat spots is within the range of from about 0.2 to about 6 meters, and more preferably, the period of the periodic flat spots is within the range of from about 0.5 to about 3 meters.

The length D of the flat spots is somewhat determined by the amount of residence time during which the strand is wound in the edge portions 20*a* and 20*b*. This can be controlled by choosing longer or shorter contact areas for the cylindrical edge ends 46*a* of the rollers 46, and by providing a longer or shorter curved end path 34*a* in the groove 34 of the cam 30. In general, a slower rotational speed for the cam 30 results in a longer residence time for the strand in the edge portions 20*a* and 20*c*. The length of the periodic flat spots is preferably within the range of from about 0.5 to about 10 cm, and more preferably within the range of from about 1 to about 5 cm.

The width L' of the flat spots can be controlled by adjusting the pressure of the rollers 46 on the package. A greater amount of pressure applied to the end portions 20*a* and 20*b* will cause a greater flattening. In normal operation the rollers 46 are moved away from the collet 22 to accommodate the increased package size. The amount of pressure exerted on the package by the rollers can be increased by increasing the initial pressure applied by the rollers and by maintaining the pressure throughout the packaging process. Also, the pressure can be increased during packaging by reducing the amount of backing off by arm 56 during packaging. It is to be understood that various ways can be used to control the pressure of the roller bails on the package, including a computer controlled motor for moving mounting arm 56 according to a predetermined plan. The pressure of the rollers can be controlled to produce the desired amount of flatness for the flat spots.

Figure 10:
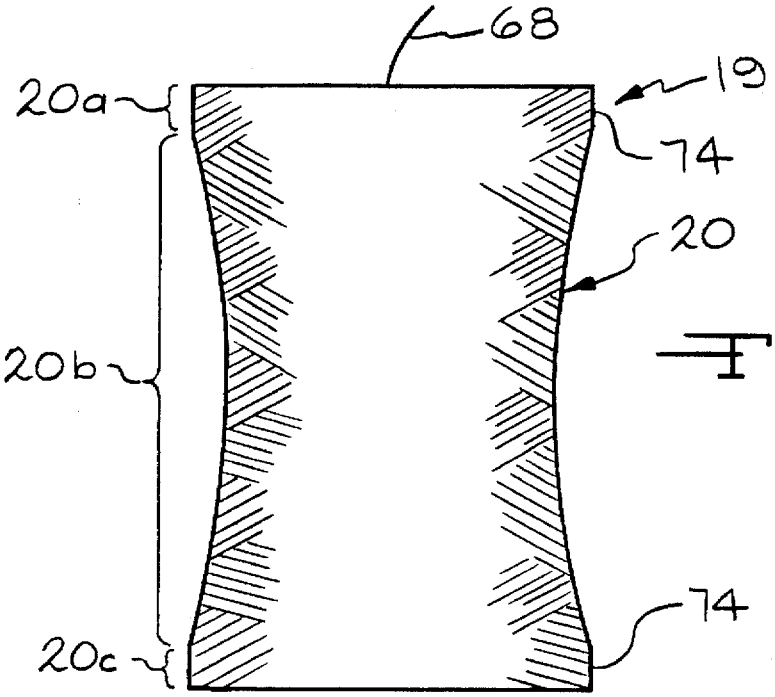
FIG. 10 is a schematic view in elevation of a package of yarn according to the invention.

As shown in FIG. 10, the package 19 is resting on its end and the periodically flattened strand 68 is being payed out from the interior of the package. The package is free standing, i.e., capable of supporting itself during the unwinding process without collapsing.

The outside surface 20 of the package is made up of generally curved central portion 20*b* and two annular plateaus 74 created at the end portions 20*a* and 20*c* by the flattening effect of the rollers 46. The plateaus are generally parallel to the longitudinal axis 76 of the package in contrast to the gently curving slope of the package in the central portion 20*b*. The amount of pressure applied by the rollers will affect the width of the plateaus. The pressure applied to the package by each of the rollers is typically within the range of from about 2 to about 10 pounds (0.91 to 4.5 kg), and preferably within the range of from about 3 to about 6 pounds (1.4 to 2.7 kg).

The flat spots 70 in the strand are positioned exclusively in the end portions 20*a* and 20*b* of the package. The increased surface area of the flat spots affects the construction of the package by providing increased adhesive contact or bonding between any particular course of the strand and its adjacent courses of strand. The bond strength is greater than that of portions of the strand having the primary cross-sectional shape. This increased bonding ability may require adjustment oft he amount of size applied to the strand, or to the adhesive quality of the size. If the bonding of the strand is too great, the strand 68 will not be easily payed out from the package. If the bonding is too loose, the strand being unwound will pay out too easily and may balloon out or otherwise become entangled. A preferred amount of average tension or force required to release or pay out the strand is expected to be within the range of from about 5 to about 100 grams.

Figure 11:
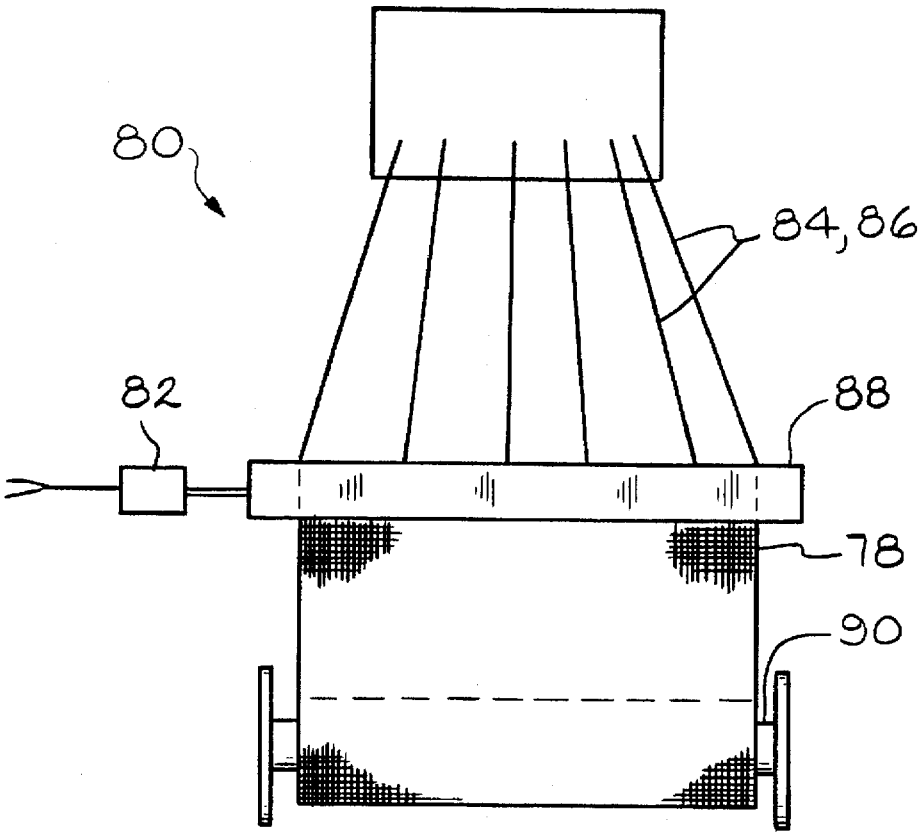
FIG. 11 is a schematic view in elevation of an air jet loom for use with the method of the invention.
Figure 12:
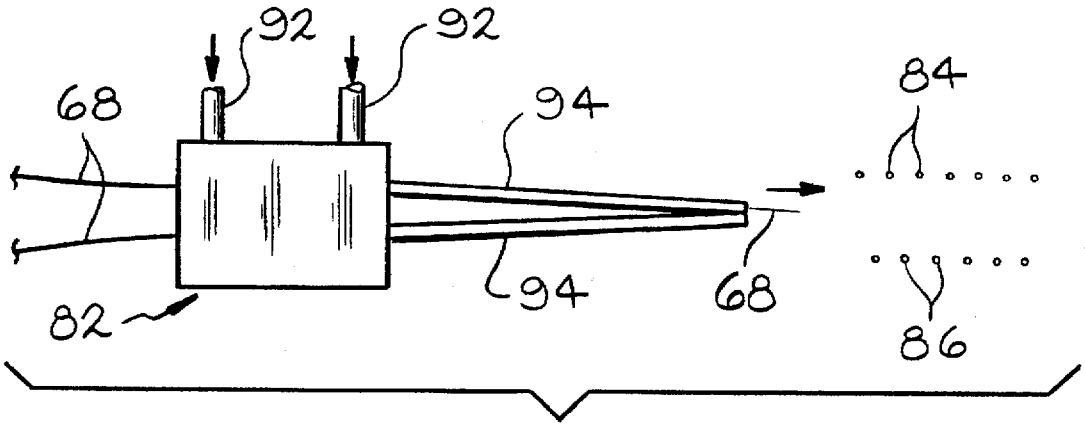
FIG. 12 is more detailed view of the air jet of loom shown in FIG. 11.

As shown in FIGS. 11 and 12, the yarn or strand 68 of the invention can be used to weave a fabric 78 on a loom 80. The loom can be an air jet loom, as shown, or can be any other type of loom. The loom is supplied with warp yarn 84, 86 and the strand 68 of the invention is inserted into the fabric as the weft or fill yarn. The operation of looms for making fabric is well known to those skilled in the art. The air jet 82 picks or propels the fill thread or strand 68 across the loom, between the shed of the upper and lower warp yarn 84 and 86. The reed 88 beats up or pushes the fill and warp yarn together to form the fabric, which can be wound or carried away by any suitable means, such as drum 90. As shown in FIG. 12, the air jet can be supplied with two fill yarn 68 and provided with separate air input lines 92 so that the fill yarn can be supplied alternately from nozzles 94. The reed 88 is provided with a series of air jets, not shown, that assist is carrying the fill yarn across the width of the loom.

The use in an air jet loom of the yarn of the invention, i.e., a yarn having periodic flat spots, enables the machine to operate more efficiently since the flat spot provides enhanced or increased air drag when subjected to the blast of air from the air jet nozzle and the air jets on the reed. In a specific embodiment of the invention, the flat spots are synchronized so that they pass through the air jet at the beginning of the propulsion of the fill yarn across the loom. It is to be understood that this synchronization is optional. Although the fabric and weaving process illustrates the yarn of the invention used as a fill yarn, the yarn of the invention can also be used as the warp yarn.

One of the characteristics of the winding apparatus of the invention is that the contact of the roller bails on the package enables the package to be made with a relatively large diameter. Also, the ratio of the diameter to the axial length the packages can be increased. The axial length of the packages can be any desired length, but is preferably within the range of from about 8 to about 40 cm. The diameter is preferably within the range of from about 20 to about 50 cm. The increased bonding of the strand at the end portions of the package provides a more stable package, one that is more likely to be able to be wound with a relatively short axial length and a relatively high diameter. This is advantageous in the strand manufacturing process because it lends itself to making multiple packages which nevertheless contain substantial yardage.

Figure 13:
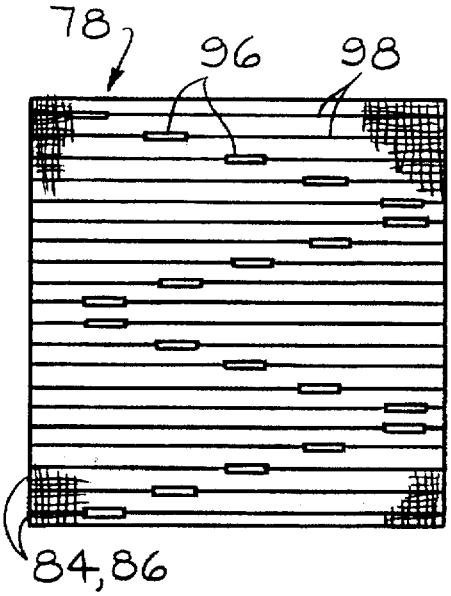
FIG. 13 is a schematic view of a fabric of the invention in which the differentiated fill yarn forms a repeating pattern in the fabric.

As shown in FIG. 13, the fabric 78 includes warp yarn 84, 86. The fill yarn includes the portions which are flat spots in the yarn, indicated at 96, as yarn that is differentiated from the remainder 98 of the fill yarn. The differentiated yarn can be formed into the fabric in the form of a pattern, as shown. The differentiated yarn differs from the remainder of the yarn primarily by its visual appearance. For example, the differentiated yarn may be lighter or darker in color than the remainder yarn. The differentiated yarn may be capable of reflecting more light than the remainder yarn. The differentiated yarn may be wider than the remainder yarn, and may have an average width which is within the range of from about 125 to about 300 percent of the average width of the remainder of the fill yarn, and preferably within the range of from about 125 to about 175 percent of the average width of the remainder of the fill yarn. The average length of the differentiated fill yarn is preferably within the range of from about 0.5 to about 10 cm, and more preferably within the range of from about 1 to about 5 cm.

Figure 14:
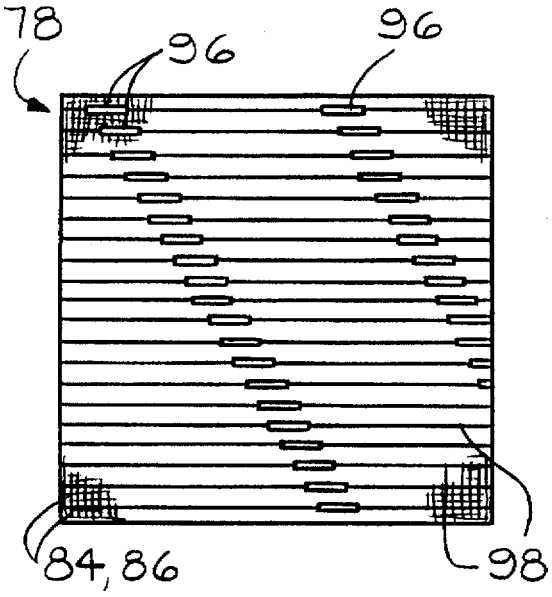
FIG. 14 is a schematic view of another fabric of the invention in which the differentiated fill yarn forms a repeating pattern in the fabric.
Figure 15:
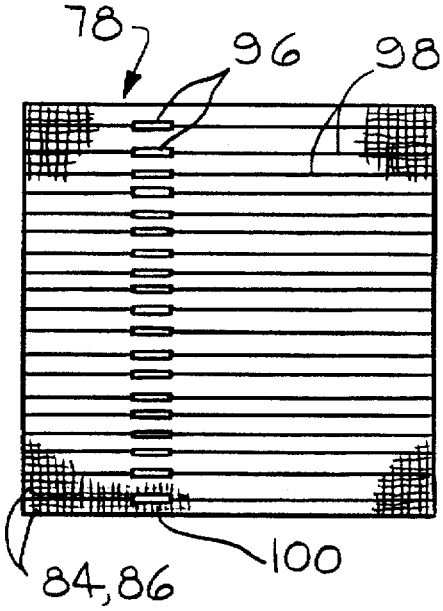
FIG. 15 is a schematic view of a fabric of the invention in which the differentiated fill yarn is generally aligned with specific warp yarn to form a longitudinal pattern in the fabric.
Figure 16:
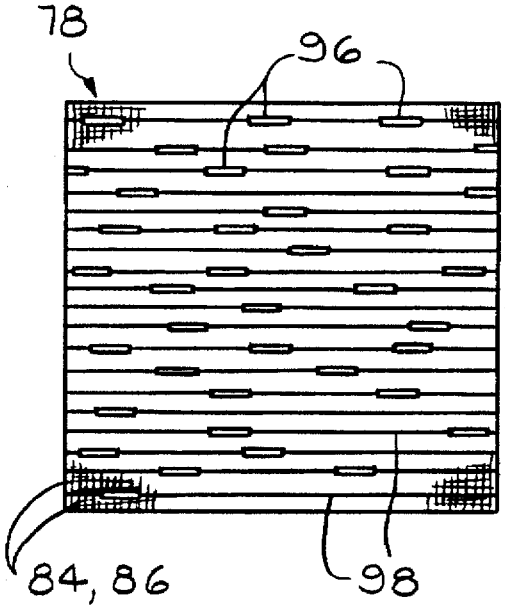
FIG. 16 is a schematic view of a fabric of the invention in which the differentiated fill yarn is generally randomly spaced throughout the fabric.

As shown in FIG. 14, the differentiated yarn can form a decorative pattern in the fabric. FIG. 15 illustrates that the differentiated fill yarn can be generally aligned with specific warp yarn 100 to form a longitudinal pattern along the length of the fabric. As shown in FIG. 16, the differentiated yarn can be generally randomly spaced throughout the fabric.

The principle and mode of operation of this invention have been described in its preferred embodiment. However, it should be noted that this invention may be practiced otherwise than as specifically illustrated and described without departing from its scope.

INDUSTRIAL APPLICABILITY

The invention can be useful in the packaging, dispensing and weaving of yarn for use as a reinforcement material.

We claim:

1. A woven fabric of glass fiber warp yarn and glass fiber fill yarn, where the glass fiber fill yarn comprises a strand of individual glass filaments, the strand having a primary cross-sectional shape and periodic flat spots with a flat cross-sectional shape which is more elongated than the primary cross-sectional shape, where the effect of the flat spots is differentiated glass fiber fill yarn in the woven fabric.

2. The woven fabric of claim 1 in which the differentiated fill yarn is lighter in color than the remainder of the fill yarn.

3. The woven fabric of claim 1 in which the differentiated fill yarn is more reflective than the remainder of the fill yarn.

4. The woven fabric of claim 1 in which the differentiated fill yarn is wider than the remainder of the fill yarn.

5. The woven fabric of claim 4 in which the differentiated fill yarn has an average width which is within the range of from about 125 to about 300 percent of the average width of the remainder of the fill yarn.

6. The woven fabric of claim 5 in which the differentiated fill yarn has an average width which is within the range of from about 125 to about 175 percent of the average width of the remainder of the fill yarn.

7. The woven fabric of claim 1 in which the average length of the differentiated fill yarn is within the range of from about 0.5 to about 10 cm.

8. The woven fabric of claim 7 in which the length of the differentiated fill yarn is within the range of from about 1 to about 5 cm.

9. The woven fabric of claim 1 in which the differentiated fill yarn is generally randomly spaced throughout the fabric.

10. The woven fabric of claim 1 in which the differentiated fill yarn is generally aligned with specific warp yarn to form a longitudinal pattern along the length of the fabric.

11. The woven fabric of claim 1 in which the differentiated fill yarn forms a repeating pattern in the fabric.

12. A woven fabric of glass fiber warp yarn and glass fiber fill yarn, where the glass fiber fill yarn comprises a strand of individual glass filaments, the strand having a primary cross-sectional shape and periodic flat spots with a flat cross-sectional shape which is more elongated than the primary cross-sectional shape, where the effect of the flat spots is differentiated glass fiber fill yarn in the woven fabric, where the differentiated glass fiber fill yarn is wider than the remainder of the glass fiber fill yarn and has an average length within the range of from about 0.5 to about 10 cm, and where the differentiated glass fiber fill yarn has an average width within the range of from about 125 to about 300 percent of the average width of the remainder of the glass fiber fill yarn.

13. The woven fabric of claim 12 in which the differentiated fill yarn is more reflective than the remainder of the fill yarn.

14. The woven fabric of claim 12 in which the differentiated fill yarn is generally randomly spaced throughout the fabric.

15. A woven fabric of glass fiber warp yarn and glass fiber fill yarn, where the glass fiber warp yarn comprises a strand of individual glass filaments, the strand having a primary cross-sectional shape and periodic flat spots with a flat cross-sectional shape which is more elongated than the primary cross-sectional shape, where the effect of the flat spots is differentiated glass fiber warp yarn in the woven fabric.

16. The woven fabric of claim 15 in which the differentiated warp yarn is lighter in color than the remainder of the warp yarn.

17. The woven fabric of claim 15 in which the differentiated warp yarn is more reflective than the remainder of the warp yarn.

18. The woven fabric of claim 15 in which the differentiated warp yarn has an average width which is within the range of from about 125 to about 300 percent of the average width of the remainder of the warp yarn.

19. The woven fabric of claim 15 in which the average length of the differentiated warp yarn is within the range of from about 0.5 to about 10 cm.

20. The woven fabric of claim 15 in which the differentiated warp yarn is generally randomly spaced throughout the fabric.

* * * * *